US010812897B1

(12) United States Patent
Arango-Vargas et al.

(10) Patent No.: US 10,812,897 B1
(45) Date of Patent: Oct. 20, 2020

(54) AUDIO SYSTEM

(71) Applicant: Human, Incorporated, Seattle, WA (US)

(72) Inventors: Eliza Arango-Vargas, Redmond, WA (US); Lane Kleppen, Kirkland, WA (US)

(73) Assignee: Human, Incorporated, Seattle, WA (US)

( * ) Notice: Subject to any disclaimer, the term of this patent is extended or adjusted under 35 U.S.C. 154(b) by 0 days.

(21) Appl. No.: 16/654,758

(22) Filed: Oct. 16, 2019

Related U.S. Application Data

(63) Continuation of application No. 15/923,917, filed on Mar. 16, 2018, now abandoned.

(60) Provisional application No. 62/473,160, filed on Mar. 17, 2017.

(51) Int. Cl.
*H04R 1/30* (2006.01)
*H04R 1/02* (2006.01)

(52) U.S. Cl.
CPC ..... *H04R 1/30* (2013.01); *H04R 1/025* (2013.01); *H04R 1/026* (2013.01)

(58) Field of Classification Search
CPC ..... G10K 11/16; G10K 11/168; G10K 15/04; G10K 15/043; F16F 9/306; B25D 17/11; F01N 13/08; G01S 1/72; H04R 1/22; H04R 1/28; H04R 1/2807; H04R 1/2815; H04R 1/2819; H04R 1/288; H04R 1/2869; H04R 1/2876; H04R 1/2861; H04R 1/30; H04R 1/34; H04R 1/345; H04R 1/2853; H04R 1/20
USPC ..... 381/338, 339, 340, 341, 345, 347, 352, 381/354, 362, 363, 366; 181/146, 151, 181/166, 196, 199
See application file for complete search history.

(56) References Cited

U.S. PATENT DOCUMENTS

| | | | | |
|---|---|---|---|---|
| 8,606,931 | B2 * | 12/2013 | Matsushita | H04L 61/2575 709/225 |
| 9,832,560 | B1 * | 11/2017 | Bagga | H02J 7/0044 |
| 10,129,647 | B2 * | 11/2018 | Seo | H04R 5/02 |
| 10,362,400 | B2 * | 7/2019 | Yan | H04R 5/0335 |
| 10,412,480 | B2 * | 9/2019 | Patil | H04R 1/2857 |
| 2015/0296285 | A1 * | 10/2015 | Proos | H04R 1/025 381/333 |
| 2016/0021446 | A1 * | 1/2016 | Litovsky | H04R 1/347 381/338 |
| 2016/0337750 | A1 * | 11/2016 | Louis | H04R 1/403 |
| 2017/0111733 | A1 * | 4/2017 | Litovsky | H04R 5/0335 |

(Continued)

*Primary Examiner* — Binh Kien Tieu
(74) *Attorney, Agent, or Firm* — Seed IP Law Group LLP

(57) ABSTRACT

Various embodiments are directed to an audio system. The audio system may include a first audio device that includes a casing that houses a speaker and an internal waveguide. The internal waveguide may be configured to direct sound from the speaker to ambient air outside the casing. In some embodiments, the casing of the first audio device may be configured such that, when the first audio device physically engages or is otherwise coupled to a surface of an object (e.g., when the casing is placed on a surface of a table), an external surface of the casing forms, in conjunction with the surface of the object, an extended waveguide. The extended waveguide may be longer than the internal waveguide, which may provide several benefits to the operation of the first audio device versus when the first audio device is not coupled to the surface of the object.

18 Claims, 6 Drawing Sheets

(56) References Cited

U.S. PATENT DOCUMENTS

| | | | | |
|---|---|---|---|---|
| 2018/0070163 | A1* | 3/2018 | Harper | H04R 1/1016 |
| 2019/0349666 | A1* | 11/2019 | Patil | H04R 1/1016 |

* cited by examiner

AUDIO SYSTEM

RELATED APPLICATION

This application is a continuation of U.S. application Ser. No. 15/923,917, filed Mar. 16, 2018, which claims priority to U.S. Provisional Application No. 62/473,160 entitled "AUDIO SYSTEM," filed on Mar. 17, 2017, the entire contents of which are hereby incorporated by reference.

BACKGROUND

Some audio systems—such as headphones and earphones—include speaker elements that are worn in proximity to users' ears. These speaker elements may output audio at a comparatively low volume that enable users wearing such audio systems to experience media without disturbing others nearby. Some other audio systems include speaker elements that are configured to output audio at a volume that can be heard by a group of users in proximity to these audio systems (e.g., in the same room). However, current audio systems are not configured to operate as both a personal-listening device (e.g., headphones) and as a group-listening device (e.g., a public-address system). As a result, a user may need to utilize one audio system for personal-listening activities and another, separate audio system for group-listening activities.

SUMMARY

Various embodiments provide for an audio device that may include an external surface, an internal waveguide having a throat and an internal mouth, and a speaker acoustically coupled to the internal waveguide via the throat. In some embodiments, the internal mouth may be configured as an opening in the exterior surface and, while the audio device is coupled to an object, the external surface may be configured to form, with a surface of the object, an extended waveguide that includes an extended mouth. In some embodiments, a first portion of an internal surface of the internal waveguide may be configured to transition into the external surface from the internal mouth or adjoin the external surface. In some embodiments, while the audio device is coupled to the object, a second portion of the internal surface that is proximate to the internal mouth may adjoin the surface of the object. In some embodiments, while the audio device is coupled to the object, the internal waveguide may adjoin the surface of the object at the internal mouth such that the surface of the object forms a tangency with a curvature of the internal waveguide.

In some embodiments, while the audio device is coupled to the object, the speaker may be configured to output sound via an extended mouth of the extended waveguide. In such embodiments, while the audio device is not coupled to the object, the speaker may be configured to output sound via the internal mouth of the internal waveguide. In some embodiments, a cross-sectional area of the internal mouth may be larger than a cross-sectional area of the throat, and a cross-sectional area of the extended mouth may be larger than the cross-sectional area of the internal mouth.

In some embodiments, a portion of the audio device may be configured to engage the surface of the object, and the portion of the audio device may be configured to limit rotational movement of the audio device along the surface of the object. In some embodiments, the audio device may also include a first coupling device configured to couple the audio device to the object. In such embodiments, the first coupling device may include a magnetic element, and the first coupling device may be configured to couple to a second coupling device included in the object via magnetic attraction.

In some embodiments, the posterior portion of the audio device may include at least a portion of the internal waveguide. In such embodiments, the internal mouth may form the opening in the posterior portion of the audio device. In some embodiments, the audio device may include a first coupling device configured to couple to a second coupling device included in another audio device. In some embodiments, the speaker may be configured as a group-listening speaker. In such embodiments, the audio device may include another speaker configured as a personal-listening speaker.

Various embodiments may further provide for a system that includes a base device and a first audio device. In such embodiments, the base device may include a surface. The first audio device may be couplable to the base device and may include an external surface, an internal waveguide having a throat and an internal mouth, and a speaker acoustically coupled to the internal waveguide via the throat. In some embodiments, the internal mouth may be configured as an opening in the exterior surface. In some embodiments, while the audio device is coupled to the base device, the external surface may be configured to form, with the surface of the base device, an extended waveguide comprising an extended mouth, and sound output from the speaker may be directed from the throat through the extended mouth.

In some embodiments, the first audio device may include comprises a first coupling device, the base device may include a second coupling device, the first coupling device may be configured to couple to the second coupling device, and the external surface may be configured to form, with the surface of the base device, the extended waveguide when the first coupling device is coupled to the second coupling device. In some embodiments, the system may also include a second audio device configured as a mirror image of the first audio device. In such embodiments, the first audio device may include a first coupling device, the second audio device may include a second coupling device. The first audio device and second audio device may be selectively couplable together via the first coupling device and the second coupling device. The external surface may be configured to form, with the surface of the base device, the extended waveguide when the first audio device is coupled to the second audio device and the base device, and another external surface of the second coupling device may be configured to form, with the surface of the base device, another extended waveguide when the second audio device is coupled to the first audio device and the base device.

Various embodiments may further provide for an audio device that may include a casing having a posterior portion, an anterior portion, and an internal waveguide coupled to a speaker system. In such embodiments, the posterior portion may be configured to be couplable with a surface of an object, and the internal waveguide may form an opening in an exterior surface of the posterior portion of the casing. The casing may be configured such that, when the posterior portion of the casing is coupled to the surface of the object, the external surface forms, with a surface of the object, an extended waveguide.

BRIEF DESCRIPTION OF THE DRAWINGS

The foregoing embodiments and many of the attendant advantages will become more readily appreciated as the same become better understood by reference to the following detailed description, when taken in conjunction with the accompanying drawings, wherein.

DETAILED DESCRIPTION

Figure 1A:
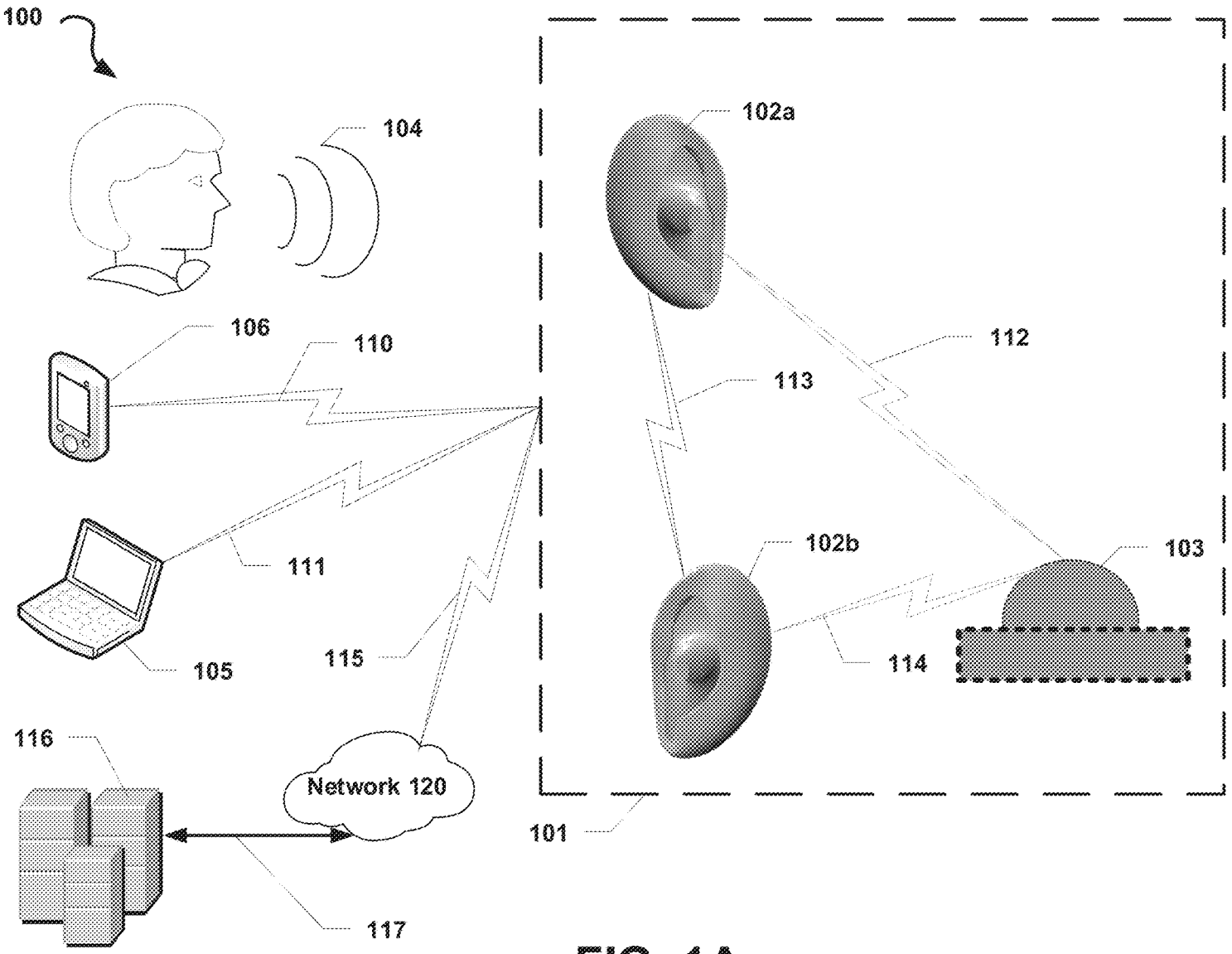
FIG. 1A is a communication system diagram illustrating an audio system that includes at least one audio device, according to some embodiments.

Some audio systems include a speaker coupled to a waveguide. As used herein, the term "waveguide" (sometimes referred to as an "acoustic horn" or simply as a "horn") refers to a physical structure of an audio system that controls the direction of sound generated from a speaker and/or that facilitates impedance matching between air near the speaker and the ambient air. A waveguide may have a substantially elongated, hollow, or tube-like shape. One end of the waveguide (referred to herein as the "throat" of the waveguide) is coupled to or positioned proximate to the portion of the speaker that outputs sound (e.g., the speaker's diaphragm). Another end of the waveguide (referred to herein as the "mouth" of the waveguide) forms an opening leading to ambient air (e.g., air external to the waveguide). Sound output from a speaker coupled to the waveguide enters the waveguide via the throat. The internal surfaces of the waveguide direct the sound through the hollow body of the waveguide until the sound exits the waveguide's mouth.

The waveguide may be tapered from the mouth to the throat to improve impedance matching between air near the speaker's diagram and the ambient air. For example, the waveguide may be configured such that a cross-sectional area of the waveguide (e.g., an area of the air-filled space inside a cross section of the waveguide) closer to the throat of the waveguide is smaller than a cross-sectional area of the waveguide closer to the mouth. When the waveguide is configured to have such a tapered shape, the waveguide may create a high-to-low impedance gradient in which the impedance of air in the waveguide nearer the waveguide's throat is higher than the impedance of air in the waveguide nearer the mouth. By reducing the impedance mismatch between air near the speaker and the ambient air, the waveguide may enable the speaker to transfer more energy from the speaker's diaphragm to the ambient air, thereby improving the speaker's overall efficiency.

Audio systems including a longer waveguide may experience superior performance to audio systems having a shorter waveguide. A longer waveguide may create a more gradual, high-to-low impedance gradient than a shorter waveguide, thereby enabling a speaker utilizing the longer waveguide to generate sound more efficiently than when using a shorter waveguide. For example, using an equivalent amount of power, a speaker coupled to a longer waveguide may generate louder sounds than sounds output from the same speaker coupled to a shorter waveguide. Further, a longer waveguide may be more capable of directing sounds having lower frequencies (e.g., longer wavelengths) than a shorter waveguide.

A waveguide having a larger mouth (in other words, a larger cross-sectional area at the mouth of the waveguide) may output higher-quality sound than sound output via a waveguide having a smaller mouth. Specifically, the impedance difference between air in the waveguide and the ambient air (e.g., as described above) may cause some sound (or sound in certain frequencies) to be reflected at the mouth of the waveguide back towards the speaker. These reflected soundwaves can interfere with other soundwaves traveling through the waveguide in the opposite direction, thereby degrading overall sound quality. A mouth that features a larger cross-sectional area may cause fewer soundwave reflections, especially among low-frequency sounds that have longer wavelengths, than soundwave reflections caused by a mouth that features a smaller cross-sectional area. Accordingly, a waveguide having a larger mouth may cause sound output from a speaker to have at least a better bass response in comparison with a waveguide having a smaller mouth.

Currently, many portable audio systems—such as Bluetooth® portable speakers—have relatively small form factors that usually can only accommodate relatively short waveguides compared to waveguides available on larger audio systems. These form factors also typically limit such portable audio systems to having small-mouth waveguides. As a result, current portable audio systems often experience poor power usage/battery lives, a reduced capability to direct sound (especially lower-frequency sounds), and poor bass responses.

In overview, aspects of the present disclosure include audio systems that feature improvements over current audio systems, such as those described above. In various embodiments, an audio system may include a first audio device that includes a casing that houses a speaker and an internal waveguide. The internal waveguide may be configured to direct sound from the speaker to ambient air present outside the casing. In some embodiments, the casing of the first audio device may be configured such that, when the first audio device physically engages or is otherwise coupled to a surface of an object (e.g., when the casing is placed on a surface of a table and held there by gravity), an external surface of the casing forms, in conjunction with the surface of the object, an extension of the internal waveguide. For ease of description, this extension of the internal waveguide and the internal waveguide may collectively be referred to herein as an "extended waveguide."

The extended waveguide may be longer than the internal waveguide, yielding benefits to the operation of the first audio device when the first audio device is coupled to the surface of the object (in contrast to when the first audio device is not coupled to the surface of the object). By way of non-limiting examples, while coupled to the surface of the object, the relatively longer length of the extended waveguide may cause the first audio device to direct lower-frequency sounds more effectively and to produce sound more efficiently via improved impedance matching with ambient air. In some embodiments, the extended waveguide may form a mouth (sometimes referred to herein as an "extended mouth") that is larger in at least one dimension than a mouth of the internal waveguide (sometimes referred to herein as the "internal mouth"). As a result, in such embodiments, while the first audio device is coupled to the surface of the object, the first audio device system may output relatively high-quality sound—especially low-frequency sounds—because of decreased sound reflections created in the extended waveguide.

In some embodiments, the casing of the first audio device may include an external surface, a speaker, and an internal waveguide acoustically coupled to the speaker. The internal waveguide may be configured to include at least one internal surface, an internal mouth positioned at a second end of the internal waveguide, and a throat positioned at a first end of the internal waveguide. The speaker may be coupled or positioned proximate to the throat such that sound generated by the speaker is able to enter the internal waveguide through the throat. A size of at least one dimension of the throat (e.g., a diameter or cross-sectional area of the throat) may be based on a wavelength of a highest-frequency the speaker can generate.

The internal mouth may form an acoustic opening in the external surface of the casing and may define a transitional area between a first portion of the internal surface and a portion of the external surface. In some embodiments, the first portion of the internal surface may transition smoothly into the portion of the external surface. For example, the first portion of the internal surface of the internal waveguide and the portion of the external surface of the casing may be formed as one continuous surface. In another example, the first portion of the internal surface and the portion of the external surface may be separate, contiguous, or adjoining surfaces but may still generally form a smooth, continuous curvature (e.g., as described with reference to and illustrated in FIGS. 4-5). In some alternative embodiments, the first portion of the internal surface and the portion of the external surface may transition into the portion of the external surface at an edge or at another discontinuous structural feature.

When the first audio device is coupled to or otherwise physically contacts a surface of the object, a second portion of the internal surface of the internal waveguide may adjoin (or be contiguous to) the surface of the object. In the event the surface of the object is flat, the surface of the object may lie substantially tangent to a curvature of the second portion of the internal surface (e.g., as described with reference to FIG. 4). Alternatively, the second portion of the internal surface and the flat surface of the object may instead form an edge or other discontinuous structural feature. In the event the surface of the object is curved or bowl shaped, the second portion of the internal surface and the surface of the object may at least substantially form a continuous curvature while the first audio device is coupled to or physically in contact with the curved surface of the object (e.g., as described with reference to FIG. 5). Alternatively, the second portion of the internal surface and the surface of the object may instead form an edge or other discontinuous structural feature.

In some embodiments, when the first audio device is coupled to the surface of an object, the portion of the external surface of the casing and the surface of the object may form or define the extended mouth of the extended waveguide. Specifically, the portion of the external surface and the surface of the object may be collectively configured to function as an extension of the internal waveguide. By way of a non-limiting example, sound may be projected through the internal mouth, and the portion of the external surface and the surface of the object may further direct and/or guide this sound until the sound is projected in the ambient air via the extended mouth.

In some embodiments, a cross-sectional area of the extended waveguide closer to the extended mouth may be larger than a cross-sectional area of the extended waveguide closer to the internal mouth, which may in turn be larger than a cross-sectional area of the internal waveguide closer to the throat of the internal waveguide. In such embodiments, the extended mouth may have at least one dimension that is larger than at least one dimension of the internal mouth. As a result, the first audio device may experience fewer sound-wave reflections while the first audio device is coupled to the surface of the object than while the first audio device is decoupled from the surface of the object, thereby improving, at the least, the bass response of the first audio device's speaker. Further, because the extended waveguide is longer than the internal waveguide, the external waveguide may improve the efficiency of the speaker by providing better impedance matching with the ambient air and/or may direct lower-frequency sounds more effectively. However, in some alternative embodiments in which a cross-sectional area of the extended waveguide closer to the extended mouth is the same or substantially the same (or less than) the cross-sectional area of the extended waveguide closer to the internal mouth, the extended waveguide may direct lower-frequency sounds more effectively than the internal waveguide without benefiting from more efficient impedance matching (e.g., as described above).

In some embodiments, the audio system may include a second audio device. The second audio device may be configured as a mirror image of the first audio device. As such, the second audio device may include a casing that houses a speaker and an internal waveguide acoustically coupled to the speaker. The first audio device and the second audio device may be selectively coupled to each other via one or more coupling devices (e.g., interlocking components, magnets, or the like). In such embodiments, each of the first and second audio devices may be coupled to or otherwise placed in physical contact with the surface of an object to form respective extended waveguides with the external surfaces of their respective casings and the surface of the object. Coupling the first audio device with the second audio device is described further herein (e.g., with reference to FIGS. 3A-3B).

Various embodiments will be described in detail with reference to the accompanying drawings. Wherever possible, the same reference numbers will be used throughout the drawings to refer to the same or like parts. References made to particular examples and implementations are for illustrative purposes and are not intended to limit the scope of the invention or the claims.

FIG. 1A is a functional block diagram of an illustrative operating environment 100 that includes an audio system 101 suitable for implementing aspects of the present disclosure, according to some embodiments. In the example illustrated in FIG. 1A, the audio system 101 may include a first audio device 102*a* and a second audio device 102*b*. In some optional embodiments, the audio system 101 may also include a base device 103.

The first audio device 102*a* and the second audio device 102*b* may communicate with each other via a wireless communication link 113, such as a Wi-Fi Direct, Bluetooth®, or a similar communication link. In some embodiments, the first audio device 102*a* and the second audio device 102*b* may maintain a master-slave relationship in which one of the first audio device 102*a* or the second audio device 102*b* (the "master" device) coordinates activities, operations, and/or functions between the devices 102*a*, 102*b* via the wireless communication link 113. The other of the first audio device 102*a* or the second audio device 102*b* (the "slave" device) may receive commands from and may provide information or confirmations to the master device via the communication link 113. By way of a non-limiting example, the first audio device 102*a* may be the master device and may provide audio data and timing/synchronization information to the second audio device 102*b* to enable the second audio device 102*b* to begin output of the audio data in sync with output of the audio data by the first audio device 102*a*. In this example, the first audio device 102*a* may provide a data representation of a song and timing information to the second audio device 102*b* to enable the second audio device 102*a* and the first audio device 102*a* to play the song at the same time via one or more of their respective speakers. Alternatively, the first audio device 102*a* and the second audio device 102*b* may be peer devices in which each of the devices 102*a*, 102*b* shares information, sensor readings, data, and the like and coordinates activities, operations, functions, or the like between the devices 102*a*, 102*b* without one device directly controlling the operations of the other device.

The first audio device 102*a* and/or the second audio device 102*b* may be in communication with the base device 103, for example, via wireless communication links 112, 114. In some embodiments, the base device 103 may provide information or other data (e.g., audio data) to each of the first audio device 102*a* and the second audio device 102*b*. By way of a non-limiting example, the base device 103 may provide audio data and/or timing data to the first audio device 102*a* and the second audio device 102*b* to enable the devices 102*a*, 102*b* to play out the audio data at the same or nearly the same time. In some embodiments, the base device 103 may be in communication with only one of the first audio device 102*a* and the second audio device 102*b* (e.g., the "master" device, as described), and information or data provided from the base device 103 to the master device may be shared with the other one of the first audio device 102*a* and the second audio device 102*b* (e.g., the "slave" device, as described).

In some embodiments, at least one device of the audio system 101 (e.g., one of the first audio device 102*a*, the second audio device 102*b*, or the base device 103) may be in communication with one or more computing devices outside of the audio system 101 and may send and receive information and other data to and from these computing devices. In the non-limiting example illustrated in FIG. 1A, at least one device of the audio system 101 may be in communication with a mobile computing device 106 via a wireless communication link 110 and/or another computing device 105 via a wireless communication link 111. For example, the first audio device 102*a* and the second audio device 102*b* may each establish a Bluetooth® communication link with the mobile computing device 106 (e.g., a smartphone) and may stream audio from the mobile computing device 106. Those skilled in the art will recognize that the computing devices 105 and 106 may be any of a number of computing devices capable of communicating via a wireless or wired link including, but not limited to, a laptop, personal computer, personal digital assistant (PDA), hybrid PDA/mobile phone, mobile phone, smartphone, wearable computing device (e.g., wireless headphones or earphones), electronic book reader, digital media player, tablet computer, gaming console or controller, kiosk, augmented or virtual reality device, other wireless device, set-top or other television box, or the like.

Additionally (or alternatively), at least one device of the audio system 101 may be in direct or indirect communication with one or more servers 116 via at least one network 120. For example, at least one of the devices in the audio system 101 may establish a wireless communication link 115 (e.g., a Wi-Fi link, a cellular LTE link, or the like) to a wireless access point, a cellular base station, and/or another intermediary device that may be directly or indirectly in communication with the one or more servers 116 via the network 120 (e.g., via a wired communication link 117). In such embodiments, at least one of the devices in the audio system 101 may communicate indirectly with the one or more servers 116 via one or more intermediary devices. In a non-limiting example, the first audio device 102*a* and/or the second audio device 102*b* may send, via the network 120, a request for a stream of audio data from the one or more servers 116, and the one or more servers 116 may respond to the request by providing the first audio device 102*a* and/or the second audio device 102*b* with the requested stream of data. In some embodiments, at least one device of the audio system 101 may include a microphone configured to receive an analog source of sound 104 (e.g., a human's voice).

Each of the communication links 110, 111, 112, 113, 114, 115, 117 described herein may be a communication path through one or more networks (not shown), which may include wired networks, wireless networks or combination thereof (e.g., the network 120). In addition, the networks may be a personal area network, local area network, wide area network, over-the-air broadcast network (e.g., for radio or television), cable network, satellite network, cellular telephone network, or combination thereof. In some embodiments, the networks may be private or semi-private networks, such as corporate or university intranets. The networks may also include one or more wireless networks, such as a Global System for Mobile Communications (GSM) network, a Code Division Multiple Access (CDMA) network, a Long Term Evolution (LTE) network, or some other type of wireless network. Protocols and components for communicating via the Internet or any of the other aforementioned types of communication networks are well known to those skilled in the art and, thus, are not described in more detail herein.

For ease of description, the audio system is illustrated in FIG. 1A as being in communication with the devices 105, 106 and the one or more servers 116, the audio system 101. However, in some embodiments, the audio system 101 may be in communication with more or fewer computing devices and/or servers than those illustrated in FIG. 1A.

Figure 1B:
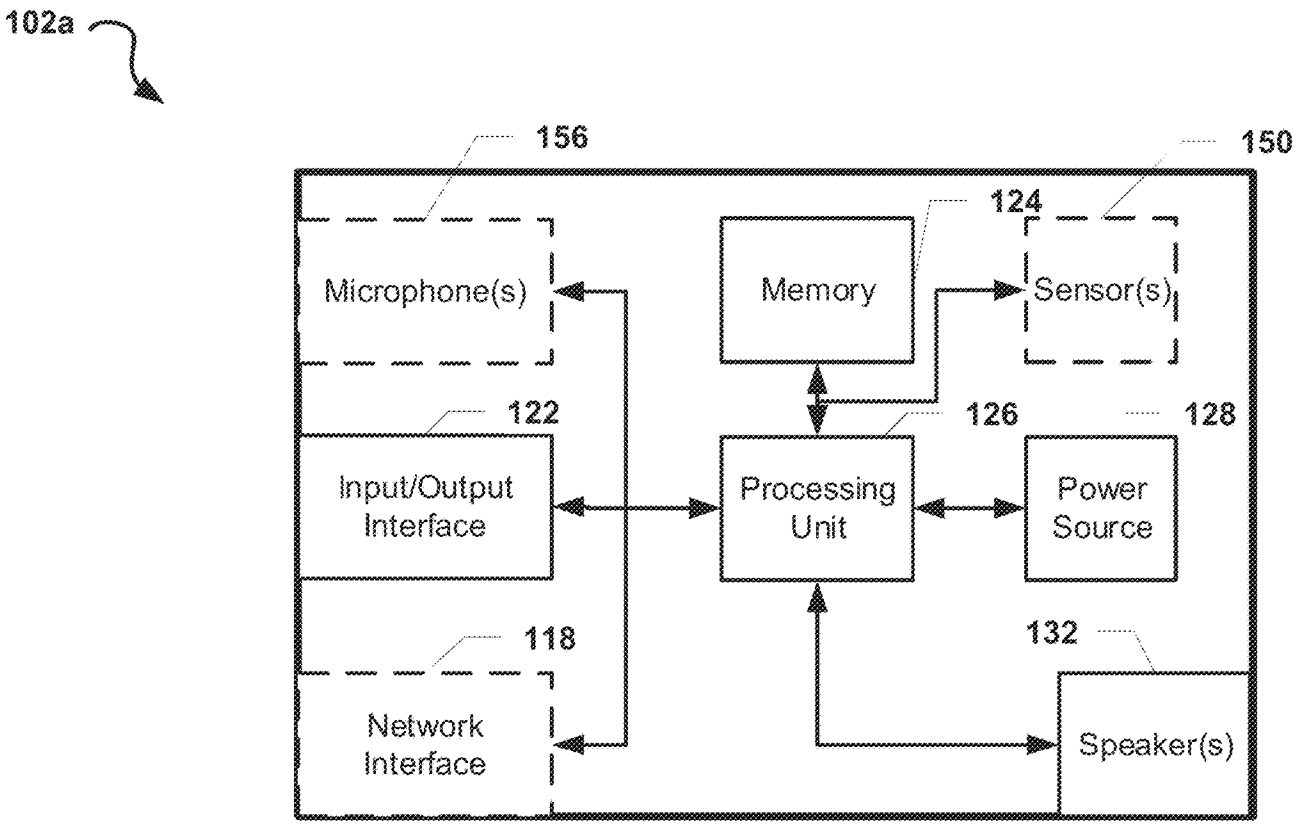
FIG. 1B is a component block diagram illustrating an audio device included in the audio system depicted in FIG. 1A, according to some embodiments.

FIG. 1B illustrates a component block diagram of the first audio device 102*a* (e.g., as described with reference to FIG. 1A), according to some embodiments. Specifically, the example illustrated in FIG. 1B depicts a general architecture of the first audio device 102*a* that may be configured to playout audio, among other functions. The general architecture of the first audio device 102*a* includes an arrangement of computer hardware and/or software components. The first audio device 102*a* may include more (or fewer) elements than those shown in FIG. 1B. It is not necessary, however, that all of these generally conventional elements be shown in order to provide an enabling disclosure.

As illustrated, the first audio device 102*a* may include an input/output device interface 122, an optional network interface 118, at least one optional microphone 156, a memory 124, a processing unit 126, a power source 128, and at least one speaker 132, all of which may communicate with one another by way of a communication bus. The network interface 118 may provide connectivity to one or more networks or computing systems, and the processing unit 126 may receive and/or send information and instructions from/to other computing systems or services via the network interface 118. For example, the network interface 118 may be configured to communicate with the second audio device 102*b*, the base device 103, the mobile computing device 106, and/or the other computing device 105 (as illustrated in FIG. 1A) via wireless communication links, such as via a Wi-Fi Direct or Bluetooth communication links. The network interface 118 may also (or alternatively) be configured to communicate with one or more computing devices via a wired communication link (not shown). In some embodiments, the network interface 118 may receive audio data from one or more other computing devices and may provide the audio data to the processing unit 126. In such embodiments, the processing unit 126 may cause the audio data to be transformed into an electrical audio signal that is provided to the at least one speaker 132 for output as sound.

The processing unit 126 may communicate to and from memory 124. In some embodiments, the memory 124 may include RAM, ROM, and/or other persistent, auxiliary or non-transitory computer-readable media. The memory 124 may store an operating system that provides computer program instructions for use by the processing unit 126 in the general administration and operation of the first audio device 102*a*. In some embodiments, the memory 124 may contain digital representations of audio data or electronic audio signals (e.g., digital copies of songs or videos with audio). In such embodiments, the processing unit 126 may obtain the audio data or electronic audio signals from the memory 124 and may provide electronic audio signals to the at least one speaker 132 for playout as sound.

In some embodiments, the input/output interface 122 may also receive input from an input device (not shown), such as a keyboard, mouse, digital pen, microphone, touch screen, touch pad, gesture recognition system, voice recognition system, image recognition through an imaging device (which may capture eye, hand, head, body tracking data and/or placement), gamepad, accelerometer, gyroscope, or another input device known in the art. In some embodiments, the at least one optional microphone 156 may be configured to receive sound from an analog sound source (e.g., the analog sound source 104 described with reference to FIG. 1A). For example, the microphone 156 may be configured to receive human speech. The microphone 156 may further be configured to convert the sound into audio data or electrical audio signals that are directly or indirectly provided to the speaker 132 for output as sound.

In some embodiments, the first audio device 102*a* may include one or more sensors 150. The one or more sensors 150 may include, but are not limited to, one or more biometric sensors, heat sensors, gyroscopic sensors, accelerometers, pressure sensors, force sensors, light sensors, or the like. In such embodiment, the one or more sensors 150 may be configured to obtain sensor information from a user of the first audio device 102*a* and/or from an environment in which the first audio device 102*a* is worn by the user. The processing unit 126 may receive sensor readings from the one or more sensors 150 and may generate one or more outputs based on these sensor readings. For example, the processing unit 126 may configure a light-emitting diode included on the audio system (not shown) to flash according to a preconfigured patterned based on the sensor 150 readings.

In some embodiments, the second audio device 102*b* (e.g., as described with reference to FIG. 1A) may be configured similarly to the first audio device 102*a* and, as such, may be configured to include components similar to or the same as one or more of the structural or functional components described above with reference to the first audio device 102*a*. In some additional (or alternative) embodiments, the base device 103 (e.g., as described with reference to FIG. 1A) may also be generally configured to include the same or similar components the first audio device 102*a* as described with reference to FIG. 1B.

Figure 2:
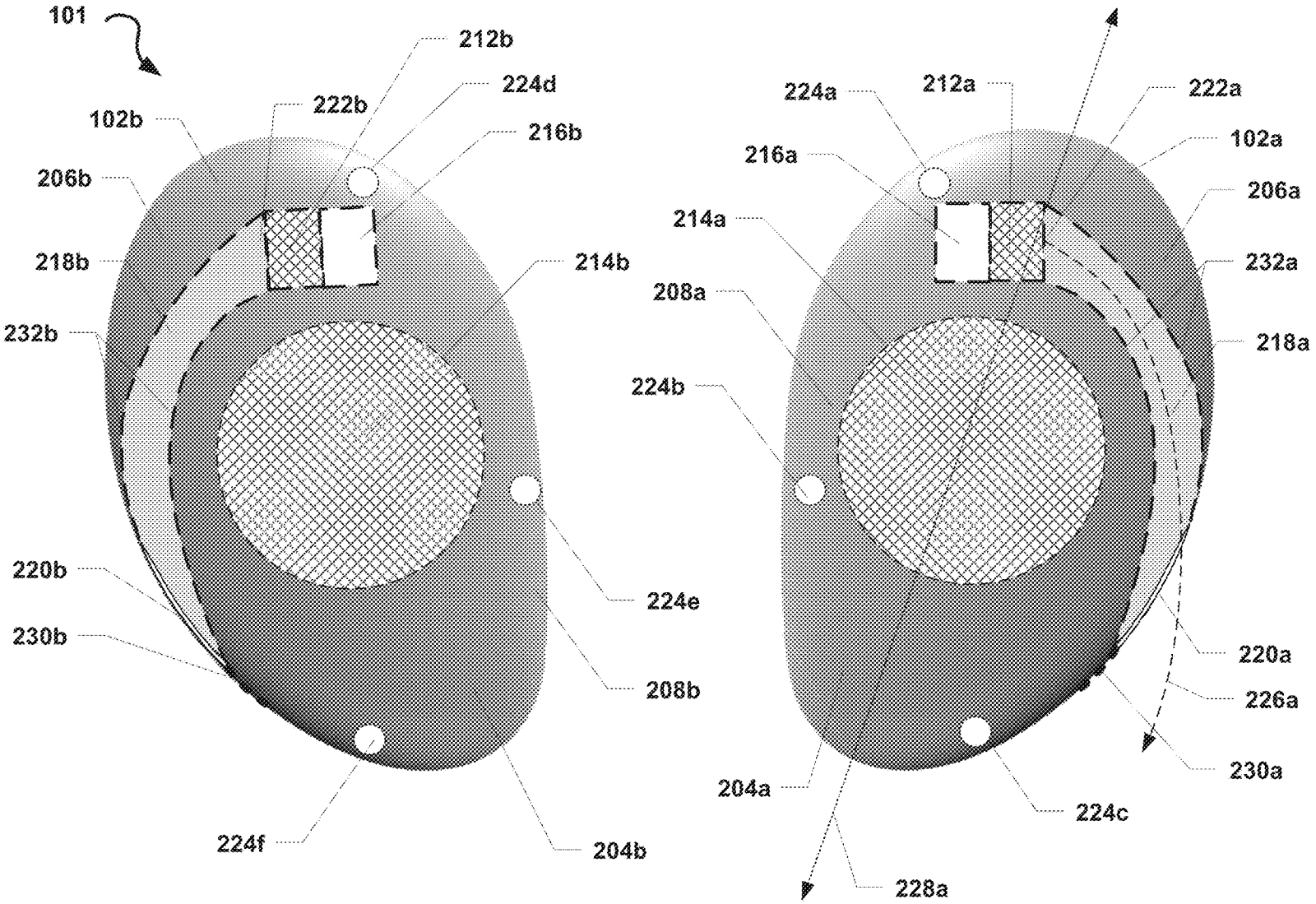
FIG. 2 is a semi-transparent, exterior view of a side of the audio system depicted in FIG. 1A, according to some embodiments.

FIG. 2 illustrates a semi-transparent view of the audio system 101, according to some embodiments. The audio system 101 may include the first audio device 102*a* and the second audio device 102*b* (e.g., as described with reference to FIGS. 1A-1B). For clarity and simplicity of description, duplicative descriptions of the audio system 101, the first audio device 102*a*, and the second audio device 102*b* may not be repeated in the following descriptions.

With reference to FIG. 2, the first audio device 102*a* may include a plurality of structural features, including without limitation: a casing 204*a* that includes a posterior portion 206*a* and an anterior portion 208*a*, one or more coupling devices 224*a*-224*c*, a first speaker 212*a*, a second speaker 214*a*, a back volume 216*a*, and an internal waveguide 218*a* that includes a throat 222*a* and an internal mouth 220*a*. Similarly, the second audio device 102*b* may include a plurality of structural features, including without limitation: a casing 204*b* that includes a posterior portion 206*b* and an anterior portion 208*b*, one or more coupling devices 224*d*-224*f*, a first speaker 212*b*, a second speaker 214*b*, a back volume 216*b*, and an internal waveguide 218*b* that includes a throat 222*b* and an internal mouth 220*b*. Various features of the audio system 101 are further described as follows.

The casing 204*a* may be made from one or more materials, including hard or soft plastic, ceramic, metal, rubber, or various other materials or combinations thereof. In some embodiments, the casing 204*a* may house one or more electrical, mechanical, and/or audio components and structures. For example, the casing 204*a* may include at least the second speaker 214*a*, the first speaker 212*a*, the back volume 216*a*, and the internal waveguide 218*a*. In another (or alternative) example (not shown), the casing 204*a* may also include one or more of the at least one optional microphone 156, the input/output interface 122, the network interface 118, the processing unit 126, the memory 124, the one or more sensors 150, and the power source 128 (e.g., as described with reference to FIG. 1B). In some embodiments, the posterior portion 206*a* of the casing 204*a* may be positioned proximate to the back side of a user while the first audio device 102*a* is secured to the user's ear. The anterior portion 208*a* of the casing 204*a* may be proximate to the front side of the user while the first audio device 102*a* is secured to the user's ear.

In some embodiments (not shown), the first audio device 102*a* may include an attachment device that enables a user to attach the first audio device 102*a* to the user's ear. Such attachment devices may include on or more attachment devices as would be known by one skilled in the art. By way of a non-limiting example, the attachment device may include a hook-shaped component that may be hooked around the user's ear to secure the first audio device 102*a* to the user.

In some embodiments, the second speaker 214*a* may be configured to play out sound at a volume that is suitable for use in a personal-listening device. For example, the second speaker 214*a* may be positioned within the first audio device 102*a* such that sound generated from the second speaker 214*a* is oriented towards the ear canal of a user when the first audio device 102*a* is secured to the user's ear. In this example, the second speaker 214*a* may be configured to play out audio that has a volume or energy that is suitable for enabling a user to hear the audio and without damaging the user's hearing or without disturbing others nearby (e.g., on a bus, in a library, or the like).

The first speaker 212*a* may be configured to play out audio at a volume that is suitable for group listening. In some embodiments, the first speaker 212*a* may be configured to output audio that is louder or that has more energy than audio that is output by the second speaker 214*a*. In a non-limiting example, a first speaker 212*a* may be configured to play out audio having a volume that is clearly audible to a group of individuals in proximity to the first audio device 102*a* (e.g., within five to ten feet).

In some embodiments, the throat 222*a* of the internal waveguide 218*a* may be coupled to the first speaker 212*a*. By way of an example, the mouth 222*a* of the internal waveguide 218*a* may be coupled to a structural enclosure that supports the diaphragm (not shown) of the first speaker 212*a*. The first speaker 212*a* may output sound into the internal waveguide 218*a* via the throat 222*a*, and the internal waveguide 218*a* may be configured to direct and/or propagate the sound towards the internal mouth 220*a* until the sound exits the casing 204*a* into the ambient air via the internal mouth 220*a*. In the example illustrated in FIG. 2, a general direction of the outputted sound through the internal waveguide 218*a* is represented by a reference line 226*a*. In some embodiments, the internal waveguide 218*a* may be configured to direct the outputted sound through the internal mouth 220*a* parallel or substantially parallel to a longitudinal axis of the first audio device 102*a* (e.g., as illustrated by reference line 228*a* in FIG. 2).

The internal waveguide 218*a* may be, at least substantially, an elongated, hollow, air-filled structure. In some embodiments, the cross-sectional shape of the internal waveguide 218 may be one or more of circular, elliptical, rectangular, polygonal, or one or more of various other geometrical shapes, and may vary in cross-sectional shape along at least a portion of a path of the internal waveguide 218*a*. In a non-limiting example in which the first speaker 212*a* is configured to have a substantially cylindrical shape, the internal waveguide 218*a* may be configured with an elliptical or circular cross-section to facilitate coupling the throat 222*a* of the internal waveguide 218*a* to the first speaker 212*a*.

In some embodiments, the internal waveguide 218*a* may be configured to have a shape that is tapered from the internal mouth 220*a* to the throat 222*a*. In such embodiments, the cross-sectional area of the internal waveguide 218*a* closer to the internal mouth 220*a* may be larger than the cross-sectional area of the internal waveguide 218 closer to the throat 222*a*. This tapering of the internal waveguide 218*a* may be continuous or discrete. For example, the cross-sectional area of the internal waveguide 218*a* may enlarge at a constant (or substantially constant) rate from the throat 222*a* to the internal mouth 220*a*, or alternatively, the cross-sectional area of the internal waveguide 218*a* may enlarge at a non-constant rate (e.g., an exponential or geometric rate). Regardless of the implementation, the tapering of the internal waveguide 218*a* may create an impedance gradient in which air occupying the internal waveguide 218*a* closer to the throat 222*a* has a higher impedance than air occupying the internal waveguide 218*a* closer to the internal mouth 220*a*. Accordingly, when the first speaker 212*a* outputs sound into the internal waveguide 218*a*, the sound may propagate through this impedance gradient and may eventually be projected into the ambient air via the internal mouth 220*a*. As described, because the internal waveguide 218*a* may be configured to create a high-to-low impedance gradient, the first speaker 218*a* may generate sound more efficiently (e.g., using a comparative less amount of power) because less of the sound's energy is lost as it moves through the internal waveguide 218*a* than if the internal waveguide 218*a* did not create a high-to-low impedance gradient.

In some alternative embodiments, the cross-sectional area of the internal waveguide 218*a* may remain relatively constant throughout. Specifically, a cross-sectional area of the internal waveguide 218*a* closer to the throat 222*a* may be the same or substantially the same as a cross-sectional area of the internal waveguide 218*a* closer to the internal mouth 220*a*. In such alternative embodiments, the internal waveguide 218*a* may not be configured to cause impedance matching (or may be configured to provide less-efficient impedance matching) between the air included in the internal waveguide 218*a* and the ambient air.

In the example illustrated in FIG. 2, the internal mouth 220*a* of the internal waveguide 218*a* may form an opening in the posterior portion 206*a* of the casing 204*a* from the interior of the casing 204*a* to the external environment. At least a first portion of an internal surface 232*a* of the internal waveguide 218*a* (e.g., a surface in contact with air residing in the internal waveguide 218*a*) may transition, at the internal mouth 220*a*, to an external surface 230*a* of the posterior portion 206*a* of the casing 204*a*. In some embodiments, the transition may be continuous or substantially continuous. For example, at least the first portion of the internal surface 232*a* may transition to the external surface 230*a* along a continuous or nearly continuous curvature so that the external surface 230*a* continues or nearly continues along the curvature of the internal surface 232*a* of the internal waveguide 218*a*. The internal surface 232*a* and the external surface 230*a* may be formed as a single continuous surface or, alternatively, as adjoining, separate surfaces.

In some alternative embodiments, the transition from at least the first portion of the internal surface 232*a* to the external surface 230*a* may be discontinuous or disjointed such that the external surface 230*a* does not continue or does not substantially continue along the curvature of the internal surface 232*a* of the internal waveguide 218*a*. Specifically, in such embodiments, the first portion of the internal surface 232*a* and the external surface 230*a* may form a discontinuous structural feature. By way of a non-limiting example, at least the portion of the internal surface 232*a* may join the external surface 230*a* at an angle (e.g., an obtuse angle or an acute angle) to form an edge. The internal surface 232*a* of the internal waveguide 218*a* and the external surface 230*a* of the posterior portion 206*a* of the casing 204*a* are further described (e.g., with reference to FIGS. 3A-3B).

The first speaker 212*a* may be coupled to the back volume 216*a* to generate sound via the diaphragm using one or more techniques known to one of ordinary skill in the art. In some embodiments, the back volume 216*a* may include or may be made from one or more sound dampening materials, including without limitation, one or more of foam, fabrics, rubbers, or the like, or combinations of the same. In such embodiments, the dampening materials may improve the bass response of the first speaker 212*a* as the dampening materials may be configured to reduce or eliminate sound that enters the back volume 216*a* from the first speaker 212*a* and that is reflected to the first speaker 212*a* because reflected sound may cause interference with or otherwise degrade sound generated at the first speaker 212*a* that is output via the internal waveguide 218*a*.

Various descriptions of the first audio device 102*a* refer to the casing 204*a* as including the anterior portion 208*a* and the posterior portion 206*a*. These descriptions are merely for ease of description and do not require or imply that the anterior portion 208*a* and the posterior portion 206*a* of the casing 204*a* are separate components. Instead, in some embodiments, the casing 204*a* may be configured as a single, continuous structure. However, in alternative embodiments, the anterior portion 208*a* and the posterior portion 206*a* of the casing 204*a* may be individual components that are joined together to form the casing 204*a*.

In some embodiments, the second audio device 102*b* may be configured in the same or substantially the same way as the first audio device 102*a* is configured (e.g., as described above). Specifically, the second audio device 102*b* may be include one or more of the same or substantially the same structural and/or functional components included in the first audio device 102*a* and, as such, may be configured to function and/or to operate the same as or similarly to the first audio device 102*a*. For example, the internal waveguide 218*b* of the second audio device 102*b* may be configured such that a portion of an internal surface 232*b* of the internal waveguide 218*b* transitions, at the mouth 220*b* of the internal waveguide 218*b*, to a portion of an external surface 230*b* of the casing 204*b* of the second audio device 102*b*.

In some embodiments, the second audio device 102*b* may be configured as a mirrored version of the first audio device 102*a* (e.g., as illustrated in FIG. 2). In such embodiments, one of the audio devices 102*a*, 102*b* may be secured to one of a user's ear and the other of the audio devices 102*a*, 102*b* may be secured to the user's other ear. For ease of description, descriptions of the second audio device 102*b* or structural/functional components of the second audio device 102*b* that are similar to descriptions of the first audio device 102*a* or to structural/functional components of the first audio device 102*a* are omitted.

Figure 3A:
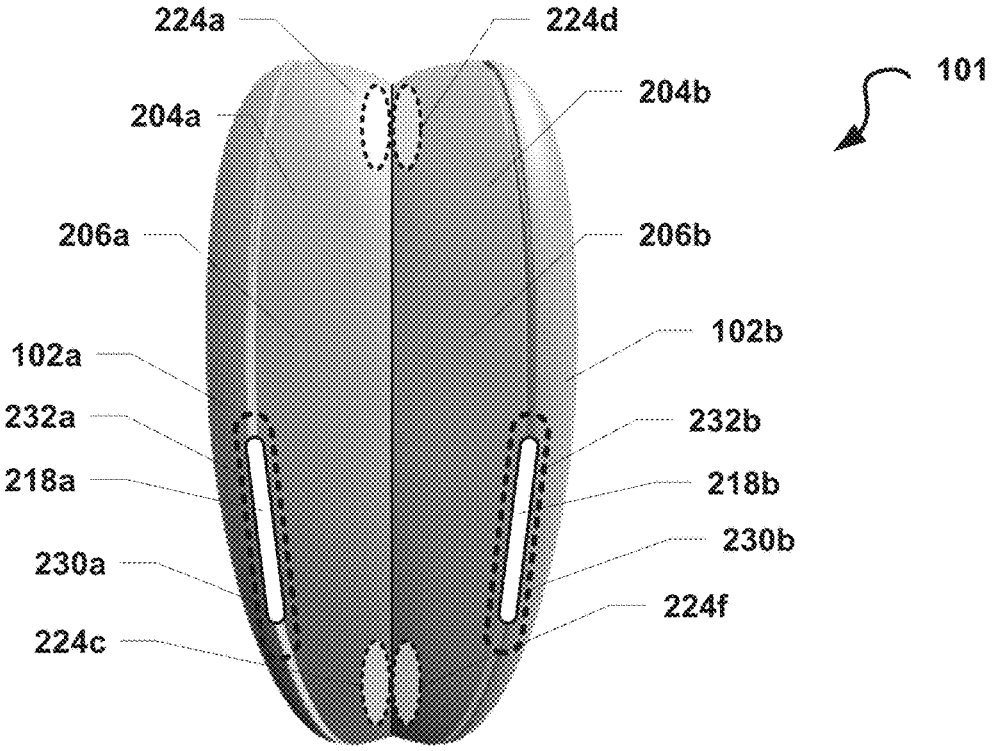
FIG. 3A is an exterior view of a posterior side of the audio system depicted in FIGS. 1A and 2, according to some embodiments.
Figure 3B:
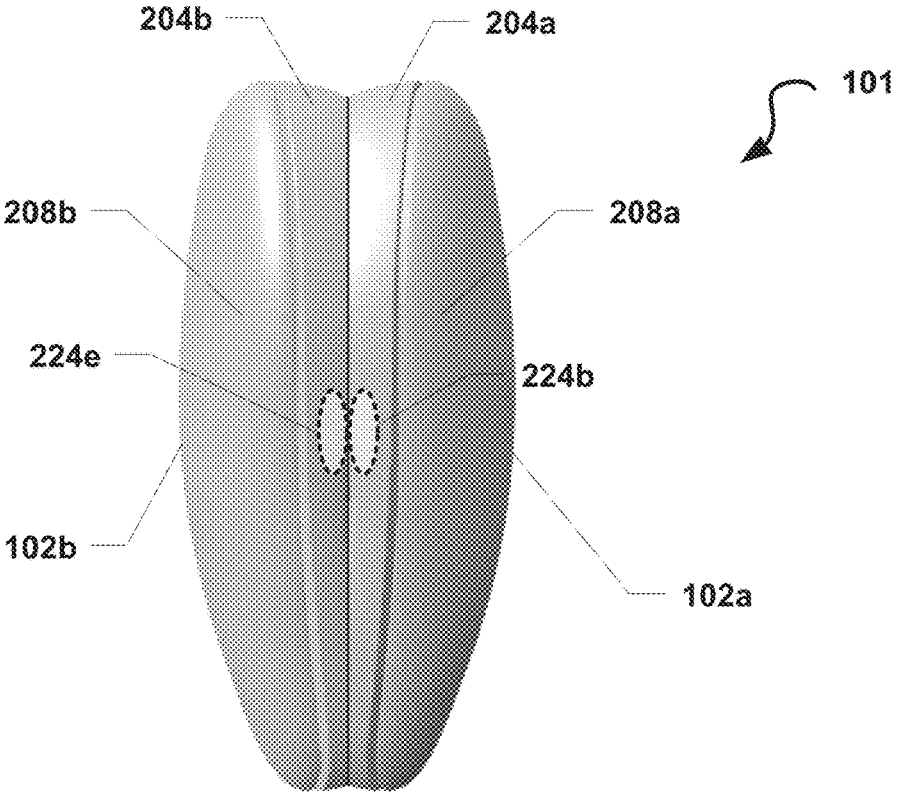
FIG. 3B is an exterior view of an anterior side of the audio system depicted in FIGS. 1A, 2, and 3A, according to some embodiments.

FIGS. 3A-3B illustrate exterior views of the audio system 101, according to some embodiments. The audio system 101 may include the first audio device 102*a* and the second audio device 102*b* (e.g., as described with reference to FIGS. 1A-2). FIG. 3A illustrates an exterior view of a posterior side of the first audio device 102*a* and the second audio device 102*b* while the devices 102*a*, 102*b* are coupled together. FIG. 3B illustrates an exterior view of an anterior side of the first audio device 102*a* and the second audio device 102*b* while the devices 102*a*, 102*b* are coupled together. For clarity and simplicity of description, duplicative descriptions of the audio system 101, the first audio device 102*a*, and the second audio device 102*b* may not be repeated in the following descriptions.

With reference to FIGS. 3A-3B, the coupling devices 224*a*-224*c* included on or in the first audio device 102*a* may be configured to engage one or more of the coupling devices 224*d*-224*f* included on or in the second audio device 102*b*. For example, in response to positioning the first audio device 102*a* in proximity to or in physical contact with the second audio device 102*b*, the coupling devices 224*a*-224*c* may engage the coupling devices 224*d*-224*f*. Once engaged, the coupling devices 224*a*-224*f* may be configured to resist forces that would separate the first audio device 102*a* from the second audio device 102*b*. In some embodiments, the coupling devices 224*a*-224*c* and the coupling devices 224*d*-224*f* may be complementary fasteners. For example, the coupling devices 224*a*-224*c* may be configured to mate physically with the coupling devices 224*d*-224*f* via one or more attachment systems, such as male/female interlocking components, hook-and-loop fasteners, non-permanent or reusable adhesives, clips, pins, latches, or the like. In such embodiments, the coupling devices 224*a*-224*f* may include a release mechanism, such as a switch, lever, or the like that may unfasten the coupling devices 224*a*-224*f* once they are fastened together. Alternatively (or additionally), once coupled together, the coupling devices 224*a*-224*f* may be decoupled by pulling the first audio device 102*a* away from the second audio device 102*b* with a force that is greater than the force holding the coupling devices 224*a*-224*f* together. In some embodiments, the coupling devices 224*a*-224*f* may include magnetic elements or may have magnetic properties. The coupling devices 224*a*-224*c* may be configured to have a magnetic polarity that is opposite of the magnetic polarity of the coupling devices 224*d*-224*f*. As such, as the first audio device 102*a* moves closer to the second audio device 104*b*, the coupling devices 224*a*-224*c* and the coupling devices 224*d*-224*f* may pull towards each other magnetically, thereby urging the first audio device 102*a* towards the second audio device 102*b*.

Figure 4:
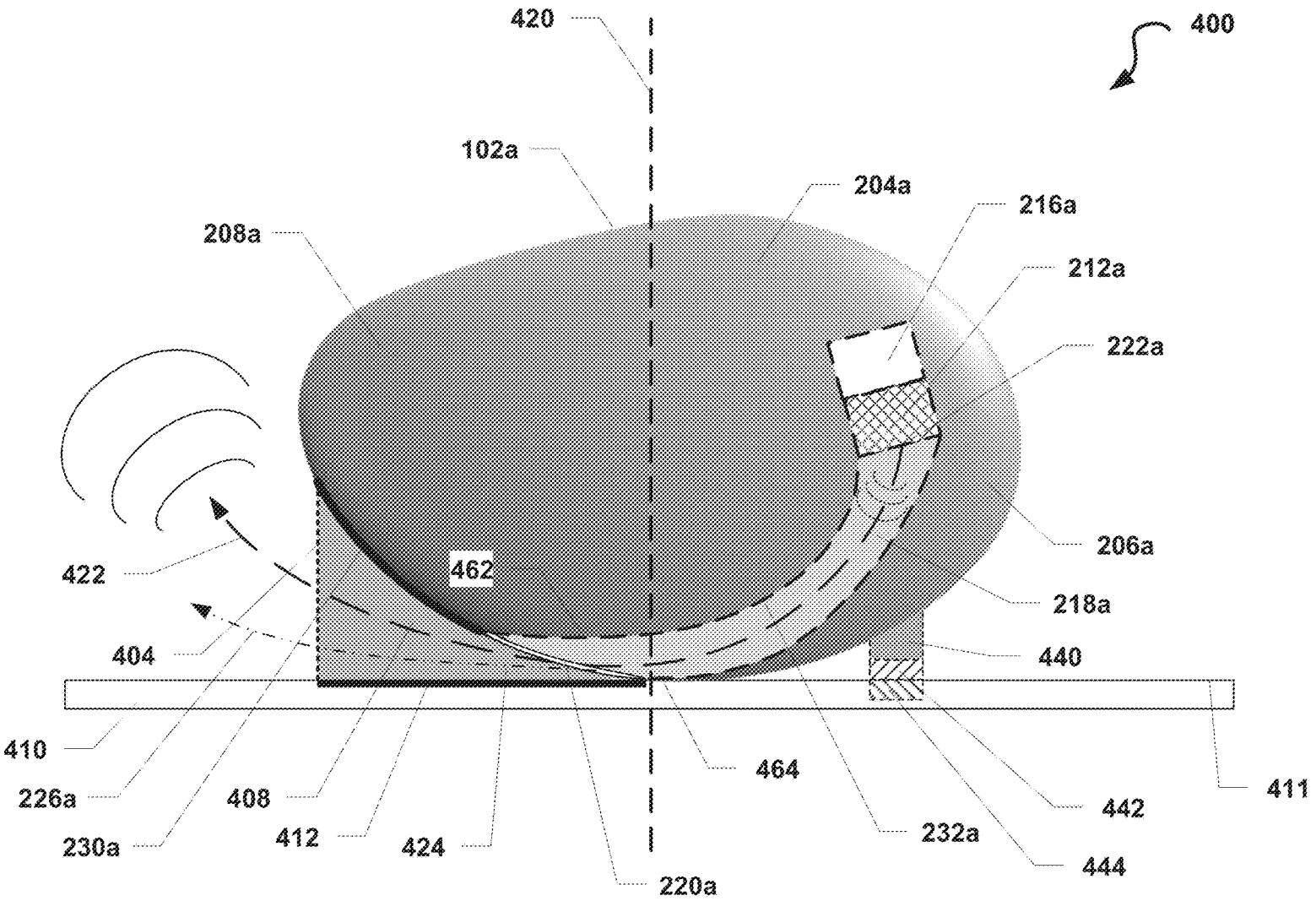
FIG. 4 is a semi-transparent, exterior view of the audio system depicted in FIGS. 1A, 2, 3A, and 3B in which at least one audio device of the audio system is resting on a surface of an object having a flat surface, according to some embodiments.

FIG. 4 illustrates a semi-transparent view of a system 400 that includes the first audio device 102*a* and an object 410, according to some embodiments. In some embodiments, the first audio device 102*a* may be configured according to one or more embodiments described herein (e.g., as described in reference to FIGS. 1A-3B). For clarity and simplicity of description, duplicative descriptions of the first audio device 102*a* may be omitted in the following descriptions.

With reference to FIG. 4, the object 410 may feature a surface 411 that is flat or substantially flat surface. By way of a non-limiting example, the object 410 may be a table, bookshelf, desk, or the like. In another example, the object 410 may be a base device configured to include a flat or substantially flat surface suitable for receiving at least the first audio device 102*a* (e.g., the base device 103 as described with reference to FIG. 1A). The object 410 may be made from one or more of various materials, including but not limited to, one or more of wood, metal, plastic, glass, rubber, ceramic, or the like or a combination thereof.

The surface 411 may be made from the same material as the rest of the object 410 or may be made from one or more different materials. In some embodiments, the surface 411 of the object 410 may be formed as a single surface or, alternatively, as multiple surfaces (e.g., adjoining surfaces) that have been joined or otherwise coupled together to form the surface 411. In some embodiments, the surface 411 may be continuous or substantially continuous. For example, the surface 411 may be smooth or may only include relatively small gaps or breaks or other imperfections. In some alternative (or additional) embodiments, the surface 411 may include one or more imperfections, including gaps, breaks, bumps, textures, and the like.

The casing 204*a* of the first audio device 102*a* may be configured to have a shape that enables at least the posterior portion 206*a* of the casing 204*a* to be placed stably on a flat or substantially flat surface, such as the surface 411 of the object 410. In a non-limiting example, the casing 204*a* may be configured to have a profile shape that is substantially elliptical (e.g., as illustrated in FIG. 4). Specifically, in this example, the first audio device 102*a* may be stably positioned on top of the surface 411 such that the posterior portion 206*a* of the casing 204*a* is in physical contact with and/or at least partially coupled to the surface 411 (e.g., via gravity) while the anterior portion 208*a* of the casing 204*a* is not in physical contact (or is only minimally in contact) with the surface 411 of the object 410.

In some optional embodiments, the first audio device 102*a* may be coupled to the surface 411 of the object 410 via one or more coupling devices. In the example illustrated in FIG. 4, the posterior portion 206*a* of the casing 204*a* may include a portion 440 having a coupling device 442. The coupling device 442 may be configured to couple directly to the surface 411 of the object 410. Alternatively (or additionally), the coupling device 442 may be configured to couple to a complementary coupling device 444 included on the surface 411 of the object 410 or embedded within the object 410. Once coupled to the surface 411 of the object 410 (directly or indirectly), the coupling device 442 may resist forces that would separate the first audio device 102*a* from the object 410. For example, the coupling devices 442, 444 may be configured to mate physically via one or more attachment systems, such as via male/female interlocking components, hook-and-loop fasteners, non-permanent or reusable adhesives, clips, pins, latches, or the like. In such embodiments, the coupling devices 442, 444 may include a release mechanism, such as a switch, lever, or the like that may unfasten the coupling devices 442, 444 once they are fastened together. Alternatively (or additionally), once coupled together, the coupling devices 442, 444 may be decoupled by pulling the first audio device 102*a* away from the surface 411 of the object 410 with a force that is greater than the force holding the coupling devices 442, 444 together. In some embodiments, the coupling devices 442, 444 may include magnetic elements or may have magnetic properties. The coupling device 442 may be configured to have a magnetic polarity that is opposite of the magnetic polarity of the coupling device 444. As such, as the first audio device 102*a* moves closer to the surface 411 of the object 410, the coupling devices 442, 444 may pull towards each other magnetically, eventually securing the first audio device 102*a* to the surface 411 of the object 410.

For ease of description, while the posterior portion 206*a* of the casing 204*a* is in physical contact with or at least partially coupled to a surface (e.g., the surface 411)—such as via gravity and/or via the coupling device 442—and the anterior portion 208*a* is not in contact with the surface (e.g., as illustrated in FIG. 4 and as described above), the first audio device 102*a* may be referred to herein as being in a "extended-waveguide configuration." Additionally, for ease of description, the first audio device 102*a* may be referred to as being in a "nonextended-waveguide configuration" while the posterior portion 206*a* of the casing 204*a* is not in physical contact with or not coupled to a surface (e.g., the surface 411) or, alternatively, while at least some of the anterior portion 208*a* of the casing 204*a* is in physical contact with the surface. By way of a non-limiting example, the posterior portion 206*a* of the first audio device 102*a* may transition from a nonextended-waveguide configuration to an extended-waveguide configuration when the posterior portion 206*a* of the casing 204*a* is placed on the surface 411 (e.g., as illustrated in FIG. 4), such as when a user of the first audio device 102*a* removes the first audio device 102*a* from the user's ear and places the first audio device 102*a* on the surface 411. The first audio device 102*a* may transition from an extended-waveguide configuration to a nonextended-waveguide configuration when the posterior portion 206*a* of the first audio device 102*a* is removed from the surface 411.

In some embodiments, the first audio device 102*a* may be configured such that a weight distribution of the first audio device 102*a* may cause the first audio device 102*a* to balance stably on the posterior portion 206*a* of the casing 204*a* with respect to an axis 420 (e.g., a center of gravity) while the first audio device 102*a* is in an extended-waveguide configuration. In some embodiments (e.g., as illustrated in FIG. 4), the first audio device 102*a* may be configured to rest on the surface of the object 410 such that at least a portion of the internal mouth 220*a* is adjacent to (or proximate to) the surface 411 of the object 410 so that the internal mouth 220*a* is not obstructed or blocked (or only slightly obstructed or blocked) by the surface 411 of the object 410.

In some optional embodiments, while the first audio device 102*a* is in an extended-waveguide configuration, at least some of the posterior portion 206*a* of the casing 204*a* may be configured to stabilize and/or support the first audio device 102*a* so that at least a portion of the internal mouth 220*a* is adjacent to (or proximate to) the surface 411. In the example illustrated in FIG. 4, the portion 440 of the posterior portion 206*a* may be configured to engage the surface 411 of the object 410 so that at least a portion of the internal mouth 220*a* is adjacent to the surface 411. In this example, the portion 440 of the posterior portion 206*a* may prevent the casing 204*a* from maneuvering (e.g., rolling) into a different position and may instead cause the casing 204*a* to remain in a position in which the internal mouth 220*a* is not obstructed or blocked (or only slightly obstructed or blocked) by the surface 411 of the object 410 and at least a portion of the internal mouth 220*a* is adjacent to the surface 411.

As illustrated in the example depicted in FIG. 4, the internal waveguide 218*a* and/or the internal mouth 220*a* may be shaped or curved such that a portion 412 of the surface 411 proximate to the internal mouth 220 is approximately tangential to the curvature of the internal waveguide 218*a* and/or internal mouth 220*a* while the first audio device 102*a* is in an extended-waveguide configuration with respect to the object 410. By configuring the curvature of the internal waveguide 218*a* and/or the internal mouth 220*a* so that the surface 411 forms an approximate tangent to such curvature, the portion 412 of the surface 411 may continue to direct sound generated from the internal mouth 220*a* with minimal (or no) distortions in the sound. Alternatively, in some embodiments, the internal waveguide 218*a* and/or the internal mouth 220*a* may have a curvature that does not form an approximate tangency with the surface 411, for example, by approaching the surface 411 at an angle. In such alternative embodiments, the portion 412 of the surface 411 may continue to direct sound generated from the internal mouth 220*a*, but such sound may experience comparatively more reflections than if the portion 412 of the surface 411 were approximately tangential to the curvature of the internal waveguide 218*a* and/or the internal mouth 220*a*. Thus, if the portion 412 of the surface 411 is approximately tangent to the curvature of the internal waveguide 218*a* and/or the internal mouth 220*a*, sound that is generated from the internal mouth 220*a* may be reflected back by the portion 412 of the surface 411 into the internal waveguide 218*a* to a comparatively lesser extent than if the curvature of the internal waveguide 218*a* and/or the internal mouth 220*a* abutted the portion 412 of the surface 411 at a different angle of approach (e.g., a forty-five degree angle).

In some alternative embodiments (not shown), an external surface of the posterior portion 206*a* of the casing 204*a* may be positioned between at least a portion of the internal mouth 220*a* and the surface 411 of the object 410. For example, such an external surface may protrude from the internal mouth 220*a* and may adjoin or otherwise be adjacent to the surface 411 while the first audio device 102*a* is in an extended-waveguide configuration. In such alternative embodiments, sound generated from the internal mouth 220*a* may be directed at least partially by the external surface between the portion of the internal mouth 220*a* and the surface 411 of the object 410. The sound may then continue travelling and may be directed at least in part by the surface 411 of the object 410 (e.g., as described above).

In some embodiments, while the first audio device 102*a* is an external-waveguide configuration with respect to the object 410, the external surface 230*a* of the posterior portion 206*a* of the casing 204*a* and at least the portion 412 of the surface 411 of the object 410 may form an extension of the internal waveguide 218*a* (e.g., an extended waveguide 408). In the example illustrated in FIG. 4, the external surface 230*a* of the posterior portion 206*a* of the casing 204*a* may extend or transition from at least a first portion 462 of the internal surface 232*a* of the internal waveguide 218*a*, and the portion 412 of the surface 411 may extend from at least a second portion 464 of the internal surface 232*a* of the internal waveguide 218*a*.

The external surface 230*a* and the portion 412 of the surface 411 of the object 410 may form an extended mouth 404. In some embodiments, the external surface 230*a* may be configured so that at least one dimension of the extended mouth 404 is greater than at least one dimension of the internal mouth 220*a*. In the example illustrated in FIG. 4, while the first audio device 102*a* is in an extended-waveguide configuration with respect to the object 410, the external surface 230*a* of the casing 204*a* may be configured to have a shape that curves in a direction that is perpendicular to (or substantially perpendicular to) the directional plane of the surface 411. In this example, the cross-sectional area of the extended mouth 404 may be greater than the cross-sectional area of the internal mouth 220*a* because the shape of the external surface 230*a* causes the extended waveguide 408 to flare outwards towards the extended mouth 404.

In some embodiments, a cross-sectional size of the extended waveguide 408 may continuously decrease from the extended mouth 404 to the throat 222*a* (e.g., as depicted in FIG. 4). In such embodiments, the extended waveguide 408 may facilitate more effective impedance matching than the internal waveguide 218*a* because the extended waveguide 408 is longer and may be configured to have a more gradual impedance than the internal waveguide 218*a*. As a result, while the first audio device 102*a* is in an extended-waveguide configuration, the first speaker 212*a* may generate sound (at least in some frequencies) more efficiently than when the first speaker 212*a* is in a nonextended-waveguide configuration. Additionally, the extended waveguide 408 may be more suitable for guiding or directing the path of lower-frequency sounds than the internal waveguide 218*a* as the extended waveguide 408 may be longer than the internal waveguide and, thus, can accommodate the longer wavelengths of lower-frequency sounds.

In some alternative embodiments (not shown), the external surface 230*a* may be configured such that a cross-sectional size of the extended waveguide 408 non-continuously (e.g., discretely) decreases from the extended mouth 404 to the throat 222*a*. For example, at least one dimension of the extended mouth 404 may be the same or substantially the same as at least one dimension of the internal mouth 220*a*, and the cross-sectional area of the extended waveguide 408 from the extended mouth 404 to the internal mouth 220*a* may be similar or the same in size. In such embodiments, the extended waveguide 408 may be a functional extension of the internal waveguide 218*a*, thereby creating an overall waveguide that is longer than the internal waveguide 218*a*. Thus, extended waveguide 408 may at least be configured to direct lower-frequency sounds more efficiently than the internal waveguide 218*a* alone because the extended waveguide 408 is longer than the internal waveguide 218*a*.

As described (e.g., with reference to FIG. 2), while the first audio device 102*a* is in a nonextended-waveguide configuration, the internal waveguide 218*a* may cause sound outputted from the first speaker 212*a* to follow the directional path 226*a*. However, while the first audio device 102*a* is in a coupled configured, the extended waveguide 408 formed by the external surface 230*a* of the casing 204*a* and the portion 412 of the surface 411 of the object 410 may cause sound generated from the internal mouth 220*a* to follow a different direction. In the example illustrated in FIG. 4, the extended waveguide 408 may cause outputted sound to follow the directional path 422 (instead of the directional path 226*a*) away from the surface 411 of the object 410.

In some embodiments (not shown), the second audio device 102*b* may be configured similarly to the first audio device 102*a*. Accordingly, the second audio device 102*b* may be configured to form an extended waveguide between an outer surface of the casing 204*b* of the second audio device 102*b* and a surface of an object. In such embodiments, the extended waveguide may extend from the internal waveguide 218*b*. The extended waveguide formed between the external surface 230*b* and the surface of an object may have a least one dimension that is larger than the internal waveguide 218*b*. For example, the extended waveguide may be longer, thereby facilitating an improve ability to direct lower-frequency sounds, and/or may have a more gradual impedance gradient as described with reference to the extended waveguide 408, thereby improving the efficiency at which the first speaker 212*b* generates sounds.

In some embodiments, the first audio device 102*a* and the second audio device 102*b* may be coupled together (e.g., as described with reference to FIGS. 3A-3B). In such embodiments, each of the first audio device 102*a* and the second audio device 102*b* may be configured to form extended waveguides from the external surfaces 230*a*, 230*b* of those devices 102*a*, 102*b*, and a surface of an object on which the first and second audio devices 102*b* are placed. For example, the posterior portions 206*a*, 206*b* of the first and second devices 102*a*, 102*b* may both engage or otherwise be coupled to the surface of an object when the devices 102*a*, 102*b* are coupled together and placed on the surface of that object. In this example, each of the devices 102*a*, 102*b* may generate sounds that are directed through their respective internal waveguides 218*a*, 218*b*. The sound respectively generated with the first and second speakers 212*a*, 212*b* may exit the internal mouths 220*a*, 220*b*, and continue being directed by the extended waveguides formed by the devices 102*a*, 102*b* and the surface of the object. In some embodiments, the first audio device 102*a* and the second audio device 102*b* may collectively generate stereophonic sounds (e.g., by generating separate channels of the stereophonic sound) that are projected via the respective extended waveguides of the devices 102*a*, 102*b*.

Figure 5:
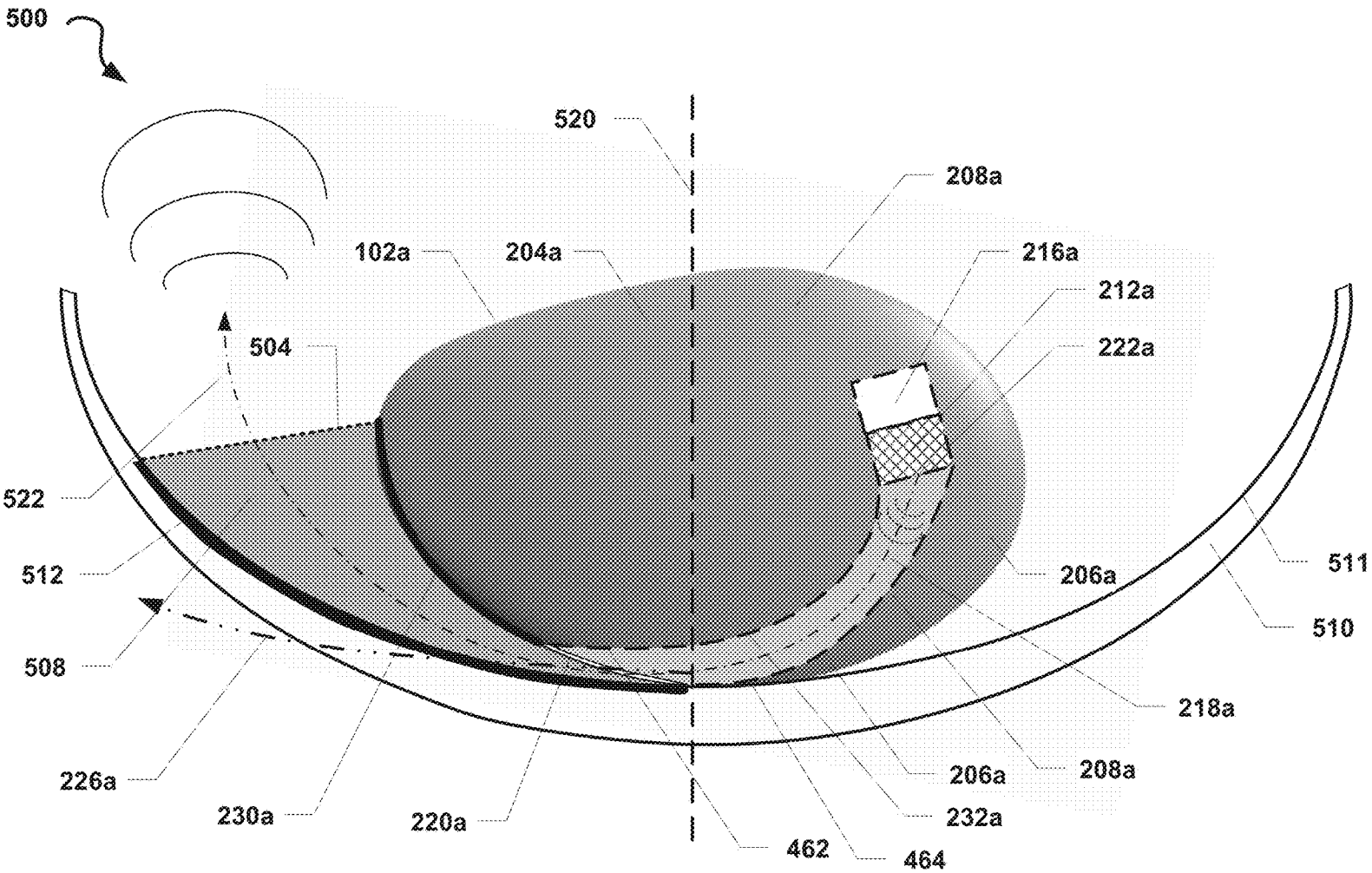
FIG. 5 is a semi-transparent, exterior view of the audio system depicted in FIGS. 1A, 2, 3A, 3B, and 4 in which at least one audio device is resting on a surface of another object having a concave surface, according to some embodiments.

FIG. 5 illustrates a semi-transparent view of a system 500 that includes the first audio device 102*a* and an object 510 having a curved surface, according to some embodiments. In some embodiments, the first audio device 102*a* may be configured according to one or more embodiments described herein (e.g., as described in reference to FIGS. 1A-4). For clarity and simplicity of description, duplicative descriptions of the first audio device 102*a* may not be repeated in the following descriptions.

With reference to FIG. 5, the object 510 may feature a surface 511 that is concave (e.g., bowl shaped). In some embodiments, the object 510 may be a base device (e.g., the base device 103 as described with reference to FIG. 1A). The object 510 may be made from one or more of various materials, including but not limited to, one or more of wood, metal, plastic, glass, rubber, ceramic, or the like or a combination thereof.

The surface 511 may be made from the same material as the rest of the object 510 or may be made from one or more different materials. In some embodiments, the surface 511 of the object 510 may be formed as a single surface or, alternatively, as multiple surfaces (e.g., adjoining surfaces) that have been joined or otherwise coupled together to form the surface 511. In some embodiments, the surface 511 may be continuous or substantially continuous. In some alternative (or additional) embodiments, the surface 511 may include one or more imperfections, including gaps, breaks, bumps, textures, and the like.

The casing 204*a* of the first audio device 102*a* may be configured to have a shape that enables at least the posterior portion 206*a* of the casing 204*a* to be placed stably on the surface 511 of the object 510. In the example illustrated in FIG. 5) the first audio device 102*a* may be stably positioned on the surface 511 (e.g., at the middle of the object 510) such that the posterior portion 206*a* of the casing 204*a* is in physical contact with and/or at least partially coupled to the surface 511 (e.g., via gravity) while the anterior portion 208*a* of the casing 204*a* is not in physical contact (or is only minimally in contact) with the surface 511 of the object 510.

In some optional embodiments (not shown), the first audio device 102*a* may be coupled to the surface 511 of the object 510 via one or more coupling devices that couple the first audio device 102*a* directly or indirectly to the surface 511 or another portion of the object 510 (e.g., the coupling device 442 described with reference to FIG. 4). Such coupling may be configured to mate physically via one or more attachment systems, such as via male/female interlocking components, hook-and-loop fasteners, non-permanent or reusable adhesives, clips, pins, latches, or the like. In some embodiments, the coupling devices may include magnetic elements or may have magnetic properties that are attracted to the surface 511 or another portion of the object 510. As such, as the first audio device 102*a* moves closer to the surface 511 of the object 510, the coupling devices may pull towards the surface 511 of the object 510 and eventually secure the first audio device 102*a* to the object 510.

In some embodiments, the first audio device 102*a* may be configured such that, while the first audio device 102*a* is in an extended-waveguide configuration with respect to the object 510, a weight distribution of the first audio device 102*a* causes the first audio device 102*a* to balance stably on the posterior portion 206*a* of the casing 204*a* with respect to an axis 520 (e.g., a center of gravity). In some embodiments (e.g., as illustrated in FIG. 5), the first audio device 102*a* may be configured to rest on the surface 511 of the object 510 such that the internal mouth 220*a* is not obstructed or blocked (or only slightly obstructed or blocked) by the surface 511 of the object 510 and at least a portion of the internal mouth 220*a* is adjacent to (or proximate to) the surface 511 of the object 510.

As illustrated in the example depicted in FIG. 5, the external surface 230*a* of the posterior portion 206*a* of the casing 204*a* and at least the portion 512 of the surface 511 of the object 510 may form an extension of the internal waveguide 218*a* (e.g., an extended waveguide 508). In the example illustrated in FIG. 5, the external surface 230*a* of the posterior portion 206*a* of the casing 204*a* may extend or transition from at least a first portion 462 of the internal surface 232*a* of the internal waveguide 218*a*, and the portion 512 of the surface 511 may extend from at least a second portion 464 of the internal surface 232*a* of the internal waveguide 218*a*.

The external surface 230*a* and the portion 512 of the surface 511 of the object 510 may form an extended mouth 504. In some embodiments, the external surface 230*a* may be configured so that at least one dimension of the extended mouth 504 is greater than at least one dimension of the internal mouth 220*a*. In some embodiments, a cross-sectional size of the extended waveguide 508 may continuously decrease from the extended mouth 504 to the throat 222*a* (e.g., as depicted in FIG. 5). In such embodiments, the extended waveguide 508 may facilitate more effective impedance matching than the internal waveguide 218*a* because the extended waveguide 508 is longer and may be configured to have a more gradual impedance than the internal waveguide 218*a*. As a result, while the first audio device 102*a* is in an extended-waveguide configuration, the first speaker 212*a* may generate sound (at least in some frequencies) more efficiently than when the first speaker 212*a* is in a nonextended-waveguide configuration. Additionally, the extended waveguide 508 may be more suitable for guiding or directing the path of lower-frequency sounds than the internal waveguide 218*a* as the extended waveguide 508 may be longer than the internal waveguide and, thus, can accommodate the longer wavelengths of lower-frequency sounds.

In some embodiments, an amount of the external surface 230*a* of the first audio device 102*a* that is configured to form the extended waveguide 508 with a curved object (e.g., the object 510) may be more than an amount of the external surface 230*a* of the first audio that forms the extended waveguide 408 with a relatively flat object (e.g., the object 410). Specifically, because the curvature of the object 510 may be similar to (or the same as) the curvature of at least a portion of the external surface 230*a* of the first audio device 102*a*, the extended waveguide 508 may extend along more of the external surface 502 in comparison to the extent to which the extended waveguide 408 extends along the external surface 402 when the first audio device 102*a* forms the external waveguide 408 with the flat (or substantially flat) surface of the object 410. Accordingly, the volume and/or length of the external waveguide 508 formed against the curved surface 504 of the object 510 may exceed the volume and/or length of the external waveguide 408 formed against a relatively flat surface of the object 410. As such, the external waveguide 508 may enable the first speaker 212*a* to generate sound (or at least some frequencies of sound) more efficiently than were the first speaker 212*a* to leverage the external waveguide 408 to generate sound.

In some embodiments (not shown), the second audio device 102*b* may be configured similarly to the first audio device 102*a*. Accordingly, the second audio device 102*b* may be configured to form an extended waveguide between an outer surface of the casing 204*b* of the second audio device 102*b* and a surface of an object. In such embodiments, the extended waveguide may extend from the internal waveguide 218*b* and/or the internal mouth 220*b*. The extended waveguide formed between the external surface 230*b* and the surface of an object may have a least one dimension that is larger than the internal waveguide 218*b*.

For example, the extended waveguide may be longer, thereby facilitating an improve ability to direct lower-frequency sounds, and/or may have a more gradual impedance gradient as described with reference to the extended waveguide 508, thereby improving the efficiency at which the first speaker 212*b* generates sounds.

While an audio device may be referred to as a first audio device or a second audio device in various descriptions provided herein, an audio device is not necessarily limited to being a "first" or a "second" audio device. Instead, unless explicitly limited in the claims, such references to an audio device as a "first" or "second" audio device are merely for ease of description, and an audio device may be either a "first" or "second" audio device. Further, while some embodiments refer to configurations in which a first audio device is configured to operate in conjunction with or to couple to a second audio device, in some alternative (or additional) embodiments, the first audio device may be configured to operate independently without a second audio device.

Various embodiments described above refer to an audio device that includes an internal mouth of an internal waveguide that forms an opening on a posterior portion of the audio device such that the mouth is adjacent to a surface of an object when the posterior portion of the audio device is coupled to or placed on the surface. Such embodiments describe that the audio device is in an extended-waveguide configuration when a posterior portion of the audio device is in contact with or otherwise coupled to a surface of an object while an anterior portion of the audio device is not in contact with or otherwise coupled to the surface of the object. However, unless otherwise recited in the claims, these descriptions are not intended to require the internal mouth of the internal waveguide to form an opening on (or only on) the posterior portion of the casing and/or that an extended waveguide is formed only when the posterior portion of the casing is coupled to or physically contacts the surface of an object. In some alternative (or additional) embodiments, the internal mouth of the internal waveguide may form one or more openings on one or more other portions on the audio device. In such alternative or additional embodiments, the one or more mouths of the internal waveguide may be adjacent to a surface of an object when such one or more other portions of the audio device are coupled to or placed on the surface of the object. For example, a mouth of the internal waveguide may form an opening on the anterior portion (or another portion) of the audio device, and the internal mouth of the internal waveguide may be adjacent to a surface of an object when the anterior portion (or another portion) of the audio device is placed on or otherwise coupled to the surface of the object. In some embodiments, an external surface of the audio device proximate to the mouths of the internal waveguide may form an extended waveguide with the surface of the object adjacent to the mouth of the internal waveguide. Thus, as described, sound outputted through the internal waveguide may exit the internal mouth, and the extended waveguide may continue directing the sound until the sound exits the extended mouth of the extended waveguide.

In some embodiments, an audio device may include an internal waveguide having one or more internal mouths. In such embodiments, the audio device may be placed or coupled to a surface of an object such that each of the one or more internal mouths is adjacent to the surface of the object. Further, one or more external surfaces of the audio device may form one or more extended waveguides with one or more portions of the surface of the object adjacent to the one or more mouths. By way of a non-limiting example, an audio device may include an internal waveguide having two separate internal mouths and one throat. In this example, the internal waveguide may originate at the throat and split into two branches that terminate at two separate internal mouths that form openings at two separate portions of the audio device. The audio device may be placed on a surface of an object such that each of the two internal mouths are adjacent to the surface of the object (e.g., as described above with reference to FIGS. 4-5). One or more external surfaces of the audio device may then form two extended waveguides with two portions of the surface of the object in proximity to the two internal mouths. While the above example describes forming two extended waveguides, in other examples, an audio device may be configured to form one or more extended waveguides with the surface of an object.

According to some embodiments, an audio system may be summarized as including: at least one wearable audio device that is configured to attach to a user's ear for personal listening, and which includes a speaker and an internal waveguide extending from the speaker to an exterior of the wearable audio device; and a base structure or device having one or more extended waveguide forming features (e.g., one or more sound guiding surfaces or passages), wherein the at least one wearable audio device is configured to mate with, nest with, or otherwise interface with the base structure or device to effectively extend the internal waveguide of the wearable audio device to enhance or otherwise modify characteristics of sound output by the speaker which travels through the internal waveguide. When the wearable audio device is mated with, nested with or otherwise interfaced with the base structure or device, an extended waveguide may be formed external to the wearable audio device. A size and/or shape of a cross-sectional area of the extended waveguide may vary, continuously or discretely, over at least a portion of a length of the extended waveguide, and may generally expand or enlarge along at least a portion of the length of the extended waveguide with increasing distance from a mouth of the internal waveguide. The extended waveguide may be formed at least in part by one or more external surfaces of a casing of the wearable audio device which cooperate with the one or more extended waveguide forming features of the base structure or device. The extended waveguide may have a completely closed or substantially closed cross-sectional profile over at least a portion of a length thereof, or may have a disjoint cross-sectional profile with open sections or areas over at least a portion of a length thereof. In some instances, the extended waveguide may be formed at least in part by one or more complex surfaces provided by the base structure or device and/or the wearable audio device. In some instances, the extended waveguide may be formed entirely by an internal waveguide passage formed in the base structure or device. Such a waveguide passage may be formed by additive manufacturing processes, molding processes or other techniques.

It is to be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

Conditional language such as, among others, "can," "could," "might" or "may," unless specifically stated otherwise, are otherwise understood within the context as used in general to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. An audio system, comprising:

a pair of audio devices selectively coupleable to each other, each audio device comprising:

an external surface;

an internal waveguide comprising a throat and an internal mouth configured as an opening in the exterior surface;

a speaker acoustically coupled to the internal waveguide via the throat; and a coupling device, wherein:

the audio devices are selectively coupleable together via the coupling devices, and while the audio devices are coupled together and to an object, the external surface of each audio device is configured to form, with a surface of the object, an extended waveguide comprising an extended mouth.

2. The audio system of claim 1, wherein, for each audio device, a first portion of an internal surface of the internal waveguide is configured to transition into the external surface from the internal mouth or adjoin the external surface.

3. The audio system of claim 2, wherein, while the audio devices are coupled together and to the object, a second portion of the internal surface of each audio device that is proximate to the internal mouth adjoins the surface of the object.

4. The audio system of claim 1, wherein, while the audio devices are coupled together and to the object, the internal waveguide of each audio device adjoins the surface of the object at the internal mouth such that the surface of the object forms a tangency with a curvature of the internal waveguide.

5. The audio system of claim 1, wherein, while the audio devices are coupled together and to the object, the speaker of each audio device is configured to output sound via the extended mouth of the extended waveguide.

6. The audio system of claim 5, wherein, while each audio device is not coupled to the object, the speaker of each audio device is configured to output sound via the internal mouth of the internal waveguide.

7. The audio system of claim 1, wherein, for each audio device:

a cross-sectional area of the internal mouth is larger than a cross-sectional area of the throat; and a cross-sectional area of the extended mouth is larger than the cross-sectional area of the internal mouth.

8. The audio system of claim 1, wherein, for each audio device:

a portion of the audio device is configured to engage the surface of the object; and the portion of the audio device is configured to limit rotational movement of the audio device along the surface of the object.

9. The audio system of claim 1, wherein each audio device further comprises a supplemental coupling device configured to couple the audio device to the object.

10. The audio system of claim 9, wherein:

the supplemental coupling device comprises a magnetic element; and the supplemental coupling device is configured to couple to a corresponding coupling device included in the object via magnetic attraction.

11. The audio system of claim 1, wherein, for each audio device, a posterior portion of the audio device comprises at least a portion of the internal waveguide.

12. The audio system of claim 11, wherein, for each audio device, the internal mouth forms the opening in the posterior portion of the audio device.

13. The audio system of claim 1, wherein the speaker of each audio device is configured as a group-listening speaker.

14. The audio system of claim 13, wherein each audio device further comprises another speaker configured as a personal-listening speaker.

15. A system, comprising:

a base device comprising a surface; and a pair of audio devices coupleable to the base device and to each other, each audio device comprising:

an external surface, an internal waveguide comprising a throat and an internal mouth configured as an opening in the exterior surface, a speaker acoustically coupled to the internal waveguide via the throat, and a coupling device, and wherein:

the audio devices are selectively coupleable together via the coupling devices, and while the audio devices are coupled together and to the base device:

the external surface of each audio device is configured to form, with the surface of the base device, an extended waveguide comprising an extended mouth; and sound output from the speaker of each audio device is directed from the throat of the internal waveguide of the audio device through the extended mouth.

16. The system of claim 15, wherein:

each audio device comprises a supplemental coupling device; and the base device comprises a first and second corresponding coupling device to couple with the supplemental coupling devices of the audio devices.

17. An audio system, comprising:

a pair of audio devices selectively coupleable to each other, each audio device comprising:

a speaker system; and a casing comprising a posterior portion, an anterior portion, and an internal waveguide coupled to the speaker system, wherein, for each audio device:

the posterior portion is configured to be couplable with a surface of an object;

the internal waveguide forms an opening in an exterior surface of the posterior portion of the casing, and the casing is configured such that, when the audio devices are coupled together and the posterior portion of the casing of each audio device is coupled to the surface of the object, the external surface forms, with a surface of the object, an extended waveguide.

18. An audio system, comprising:

a pair of audio devices selectively coupleable to each other, each audio device comprising:

an external surface;

a speaker; and a coupling device, wherein:

the audio devices are selectively coupleable together via the coupling devices, and while the audio devices are coupled together and interfaced with a base device or other object, the external surface of each audio device is configured to form, with one or more surfaces of the base device or other object, an extended waveguide through which the speakers project sound.

* * * * *